US007435315B2

(12) United States Patent
Milosavljevic

(10) Patent No.: US 7,435,315 B2
(45) Date of Patent: Oct. 14, 2008

(54) ARRANGEMENT FOR STABILIZING A WEB

(75) Inventor: Nenad Milosavljevic, Turku (FI)

(73) Assignee: Metso Paper, Inc., Helsinki (FI)

( * ) Notice: Subject to any disclaimer, the term of this patent is extended or adjusted under 35 U.S.C. 154(b) by 334 days.

(21) Appl. No.: 10/538,502

(22) PCT Filed: Dec. 15, 2003

(86) PCT No.: PCT/FI03/00951

§ 371 (c)(1),
(2), (4) Date: Jun. 9, 2005

(87) PCT Pub. No.: WO2004/057105

PCT Pub. Date: Jul. 8, 2004

(65) Prior Publication Data

US 2006/0032598 A1 Feb. 16, 2006

(30) Foreign Application Priority Data

Dec. 19, 2002 (FI) ..... 20022231

(51) Int. Cl.
*D21G 3/00* (2006.01)

(52) U.S. Cl. ..... 162/272; 34/117; 34/122; 34/123; 34/114; 162/199

(58) Field of Classification Search ..... 162/272; 34/117, 122, 123, 114, 116
See application file for complete search history.

(56) References Cited

U.S. PATENT DOCUMENTS 4,190,964 A 3/1980 Schiel (Continued)

FOREIGN PATENT DOCUMENTS

CA 1336535 6/1998

(Continued)

OTHER PUBLICATIONS

Search Report dated Sep. 5, 2003 from Finnish Patent Office for corresponding Finnish application No. FI 20022231.

*Primary Examiner*—Mark Halpern
(74) *Attorney, Agent, or Firm*—Cohen Pontani Lieberman & Pavane LLP

(57) ABSTRACT

The object of the invention is an arrangement for stabilizing a paper web (3) in a paper machine, which arrangement comprises at least three cylinders (4, 5, 6) which have been arranged so that a pocket space is formed between them, a blow box (7) arranged in the pocket space, which blow box has a blow nozzle (12), in which a nozzle slot (19) has been arranged, a separate wall (10), substantially in the direction of the blow box (7), which wall has a first edge and a second edge that are substantially parallel, which has been attached from its first edge to the blow box (7), whose height in the travelling direction of the paper web (3) is 25-300% of the height of the blow box (7) in the travelling direction of the paper web (3), in the second edge of which wall there has been arranged a boundary layer air doctor (15), which extends substantially unto the surface of the cylinder (4, 5, 6), and which wall (10) has been attached to the blow box (7) so that the blow box (7) and the wall (10) form a space in the area between the opening nip (8) and the closing nip (9) following it, into which space an underpressure can be arranged in order to support the paper web (3) towards the fabric (2) in the area between said nips (8, 9).

11 Claims, 3 Drawing Sheets

U.S. PATENT DOCUMENTS

| | | | |
|---|---|---|---|
| 4,477,983 | A | 10/1984 | Andersson et al. |
| 4,553,340 | A | 11/1985 | Petersson |
| 4,669,198 | A | 6/1987 | Wedel |
| 4,932,138 | A | 6/1990 | Liedes et al. |
| 6,115,938 | A | 9/2000 | Oechsle |
| 6,189,232 | B1 | 2/2001 | Milosavljevic et al. |
| 6,247,247 | B1 | 6/2001 | Yömaa et al. |
| 2002/0124429 | A1 | 9/2002 | Straley et al. |

FOREIGN PATENT DOCUMENTS

| | | |
|---|---|---|
| FI | 780833 | 6/1979 |
| FI | 76610 | 7/1988 |
| FI | 80103 | 1/1989 |
| FI | 102400 | 11/1998 |
| FI | 110442 | 2/2003 |
| SE | 444589 | 4/1986 |

ARRANGEMENT FOR STABILIZING A WEB

PRIORITY CLAIM

This is a national stage of PCT application No. PCT/FI2003/000951, filed on Dec. 15, 2003. Priority is claimed on Application No. 20022231, filed in Finland on Dec. 19, 2002.

BACKGROUND OF THE INVENTION

The invention relates to an arrangement for stabilizing a paper web in a paper machine or the like, in which the paper web is dried at least with the aid of cylinders and in which the paper web is kept supported towards the fabric in the area between the cylinders, i.e. in a pocket space, with the aid of a blow box. The invention relates also to a paper machine.

It is known to use blow boxes to support the web towards the fabric in the dryer section of a paper machine or the like, between the cylinders. In the publication U.S. Pat. No. 4,932,138 a blow box has been presented, which occupies almost the entire pocket space and in which there is a blow nozzle near the opening nip. No kind of an air guide between the lower cylinder and the blow box has been presented, except for the edge seals. In the publication U.S. Pat. No. 4,669,198 one solution using a big blow box is presented, which blow box has almost the size of the entire half of the pocket space, and in which there is one blow opening near the opening nip, and in the lower part, almost in a vertical direction in the upper part of the cylinder, a low air guide. The presented blow box is fairly big filling almost entirely the half of the pocket space. A big blow box is also fairly cumbersome for different purposes and expensive to manufacture. In the publication U.S. Pat. No. 6,115,938 a blow box placed in the packet space has been presented, in which blow box the supporting of the web towards the fabric has been arranged with the aid of a blow nozzle placed in the lower part of the blow box. In this structure the structures arranged in connection with the lower cylinder are, however, quite complicated and difficult to manufacture.

In the publication U.S. Pat. No. 6,189,232 a blow box has been presented from which the blow is directed towards the web so that the air flow coming along the web is prevented from drifting along with the web. A flexible wall that has been arranged in the vicinity of the blow nozzle is also presented in the publication. Moreover, in the publication seals are presented that have been arranged both on the inlet side and on the outlet side of the web so that from their other ends they are attached to the blow box and their other ends are in touch with the cylinder.

In the publication FI 110 442 a dryer section has been presented, which in its general outlines corresponds to the solution presented in the publication U.S. Pat. No. 6,189,232. In this publication, however, there is only one seal that has been arranged on the outlet side of the web. In both publications this seal is very small in dimension in relation to the dimensions of the blow box. The blow boxes are also carefully fitted in the pocket space remaining between the cylinders, in other words, their lower edges are curved following the configuration of the cylinder.

In the publication FI 76610 a solution has been presented, in which two blow boxes have been arranged in the pocket space between the cylinders. An auxiliary wall has been arranged in both blow boxes.

The problem of the above-mentioned solutions is that they need to be built separately for each paper machine, because in them the blow boxes are substantially of the same size and form as the pocket space remaining between the rolls or the cylinders.

SUMMARY OF THE INVENTION

The object of the invention is thus to present an arrangement in connection with the fabric for supporting and stabilizing the web with a fairly simple blow box, which would be quite small in its cross section and would thereby fit easily into the cylinder pocket. One main object is to present an arrangement, in which a blow box that is fairly small in its cross section, and so-called standard sized, could be fitted also to most of the old machines. Furthermore, a special object is to present an arrangement with a low energy consumption but still with an excellent stabilizing of the web.

The object of the invention is an arrangement for stabilizing a web in a paper machine, which arrangement comprises

- at least three cylinders, which have been arranged so that a pocket space is formed between them,
- a blow box arranged in the pocket space, which blow box has a blow nozzle, in which a nozzle slot has been arranged,
- a separate wall substantially in the direction of the blow box,
  - which wall has a first edge and a second edge that are substantially parallel,
  - which wall has been attached from its first edge to the blow box
  - the height of which wall in the travelling direction of the paper web is 25-300% of the height of the blow box in the travelling direction of the paper web,
  - in the second edge of which wall a boundary layer air doctor has been arranged, which doctor extends substantially unto the surface of the cylinder, and which wall has been attached to the blow box so that the blow box and the wall form a space in the area between the opening nip and the closing nip following it, into which space an underpressure is arrangeable in order to support the paper web towards the fabric in the area between said nips.

The invention thereby relates to an arrangement in connection with the fabric for stabilizing the web in a paper machine. The arrangement according to the invention can naturally be used also in other corresponding machines. The arrangement is advantageously used in that part of the paper machine in which the web is dried with the aid of cylinders and possibly also with the aid of air blows. The web is kept supported towards the fabric with the aid of a blow box in the area between the first cylinder and the second cylinder or the roll. A cylinder means in this patent application for example a drying cylinder or a plain, grooved or perforated roll.

According to one embodiment, the blow nozzle of the blow box has been placed in the travelling direction of the web so that the nozzle slot of the blow nozzle is substantially before the opening nip so that it blows air away from the underpressure space. The location before the nip means that the nozzle slot is, at the maximum, about 200 mm above the nip, advantageously at the maximum about 50 mm above the nip. Thereby the efficiency of the blow box for controlling the paper web is great. The blow box extends advantageously substantially on the entire width of the web.

According to one other embodiment of the invention, the blow box has been placed so that the nozzle slot of the blow nozzle is substantially at the opening nip. According to one further embodiment of the invention, the blow box has been placed so that the nozzle slot of the blow nozzle is, in the travelling direction of the web, substantially below the nip, e.g. at the maximum about 100 mm, advantageously at the maximum about 30 mm below the nip.

In addition, in the arrangement according to the invention, there is a separate wall substantially in the direction of the blow box. In the direction of the blow box means here that this wall has also been arranged substantially on the entire width of the web. The wall has particularly advantageously been made of a plate-like material, whereby the width and length of the wall are substantially greater than its thickness. The width of the wall means here the dimension that is in the direction of the width of the paper machine, i.e. transversely against the travelling direction of the paper web. Correspondingly, the height of the wall is the dimension that is parallel to the travelling direction of the paper web. The wall has also a first and a second edge that are substantially parallel with each other and, furthermore, they are substantially parallel to the lateral direction of the wall.

In the solution according to the invention, the said wall has been attached from its first edge to the blow box. The joint has advantageously been made so that it can be opened. Furthermore, the joint is advantageously tight, i.e. a sealing element known per se is advantageously used in it. Thereby an underpressure space is formed, in which there is no significant spillage.

The height of the wall according to the invention in the travelling direction of the paper web is 25-300% of the height of the blow box in the travelling direction of the paper web. In addition, in the other edge of the wall there has been arranged a boundary layer air doctor extending substantially unto the surface of the cylinder. "Substantially unto the surface of the cylinder" means here that the boundary layer doctor and the surface of the cylinder are mainly in touch against each other, however so that there may be e.g. a 1-2 mm gap between them. On the other hand, the boundary layer doctor is not pressed with a force towards the surface of the cylinder. This so-called boundary layer air doctor prevents as well as possible the air flow caused by the second cylinder or the roll towards the web in the area between the opening nip and the closing nip.

Thus, in the solution according to the invention there is a separate wall and a boundary layer air doctor attached to it. It can be said that in some of the solutions presented in the above-mentioned publications there is also a wall of this kind connected to a boundary layer air doctor, but in them the height of this wall is very small in relation to the height of the blow box, contrary to what is presented in this invention. On the other hand, the invention differs from the solution presented e.g. in the publication FI 76610 in that in the solution according to the invention it is possible to arrange an underpressure in the area between the opening nip and the closing nip following it.

With the solution according to the invention such an important advantage is achieved that because the said wall and the boundary layer air doctor placed in its edge can be dimensioned so as to be suitable for each case, a wall and a boundary layer air doctor of the size that is necessary in each object of use can be attached to a standard-sized blow box. Thereby savings in costs can be attained as the manufacturing of the said blow box of a standard size is carried out in series production and thus economically. The wall according to the invention, in its turn, is a plate-like product and thus more economical to manufacture that the actual blow box. Furthermore, holes that are elongated in elevation direction can be arranged in the wall, with the aid of which holes the combined height of the wall and the blow box can be adjusted.

Thus, in the solution according to the invention, the wall has been connected to the blow box so that the blow box and the wall form a space in the area between the said opening nip and the closing nip following it, into which space an underpressure can be arranged in order to support the paper web towards the fabric in the area between the said nips. In this way, a solution is achieved, which suits not only to the new machines but also to most old machines. In this way an advantageous solution from the point of view of energy consumption can be achieved, in which also the stabilizing of the web succeeds well.

The height of the said wall is determined by the machine geometry. According to one embodiment of the invention, the height of the wall in the travelling direction of the paper web is 50-150%, advantageously 70-100% of the height of the blow box in the travelling direction of the paper web. It is clear that the height of the wall with respect to the height of the blow box is chosen on the basis of the desired total height. Thereby, the height of the wall can be e.g. 25-50%, 25-80%, 25-100%, 25-90%, 50-200%, 50-120%, 50-250%, 70-100%, 70-120%, 150-300%, 150-200% or 70-150%, as well as 25, 29, 30, 36, 42, 50, 53, 61, 65, 70, 79, 75, 82, 90, 93, 100, 105, 110, 115, 120, 134, 140, 148, 159, 180, 200, 247, 268 or 295% of the height of the blow box.

According to one other embodiment of the invention, the boundary layer air doctor has been arranged in the second edge of the wall via a support element. Then the joining of the boundary layer air doctor to the wall is made easily firm and tight. It is especially advantageous if the boundary layer air doctor can be replaced without removing said support element or blow box from the machine, as then the replacement is a simple and a fairly quick operation. The boundary layer air doctor can be replaced e.g. by pulling or pushing away the doctor that is in its place and by pulling or pushing the new doctor to its place.

With the arrangement according to the invention, an underpressure that is at least 50 Pa lower than the normal pressure can advantageously be arranged into the space delimited by the blow box and the wall. More advantageously this pressure is at least 120 Pa lower that the normal pressure.

Furthermore, in the arrangement according to the invention, it is possible to arrange in connection with the blow box a flexible nozzle wall that bends elastically in fault situations, web breaks, and the like, where an enlarged safety distance is needed between the cylinder and the box. This kind of a flexible nozzle wall has typically been arranged near the blow nozzle, in the machine direction a little after it. Advantageously the flexible nozzle wall is just above the nip. A flexible nozzle wall means both a wall that is made of a flexible material, and an element stiff as such that has been arranged so as to be flexible e.g. with the aid of a spring or a turning joint or that has been arranged so as to move around its axis or point of articulation. This kind of a flexible nozzle wall can function either with spring force or with gravitational force. One flexible nozzle wall suitable for use in an arrangement according to the invention has been presented below in connection with the description of the drawing. One other nozzle wall, known per se, also suitable for use in an arrangement according to the invention has been presented in the applicant's patent FI 102400.

In the vicinity of the blow nozzle there can be arranged a flexible strip that bends elastically if, in a fault situation foreign material, such as paper chaff or the like comes along the web. Then this foreign material does not break the structures. Also the above-presented nozzle wall is able to bend elastically if foreign material comes along with the web.

The arrangement according to the invention can be used in such machines whose web speed is normally at the maximum 1000 m/min, even though the scope of use of the invention is typically in such applications in which the web speed is between 600-1400 m/min. The arrangement according to the invention is especially useful in modernizations of old machines which often present also problems of space when placing big blow boxes into the machine structures.

The boundary layer air doctor is advantageously manufactured of a material that is flexible to at least some degree and/or it is arranged so that it can bend elastically. In this case it is likely that the possibly created chaff or other foreign material does not cause damages to the equipment.

It is recommended that the said blown air is produced by using one or more blowers. The power required by the blowers is then quite reasonable and the channels and the equipment are fairly small in size.

Furthermore, an object of the invention is a paper machine that comprises an arrangement as presented above for stabilizing a paper web.

BRIEF DESCRIPTION OF THE DRAWINGS

In the following, the invention is described more closely with reference to the enclosed drawing, in which FIG. 1 schematically and, for the sake of clarity, some what exaggerated illustrates one runnability problem arising in paper machines.

DETAILED DESCRIPTION OF THE PRESENTLY PREFERRED EMBODIMENTS

Figure 1:
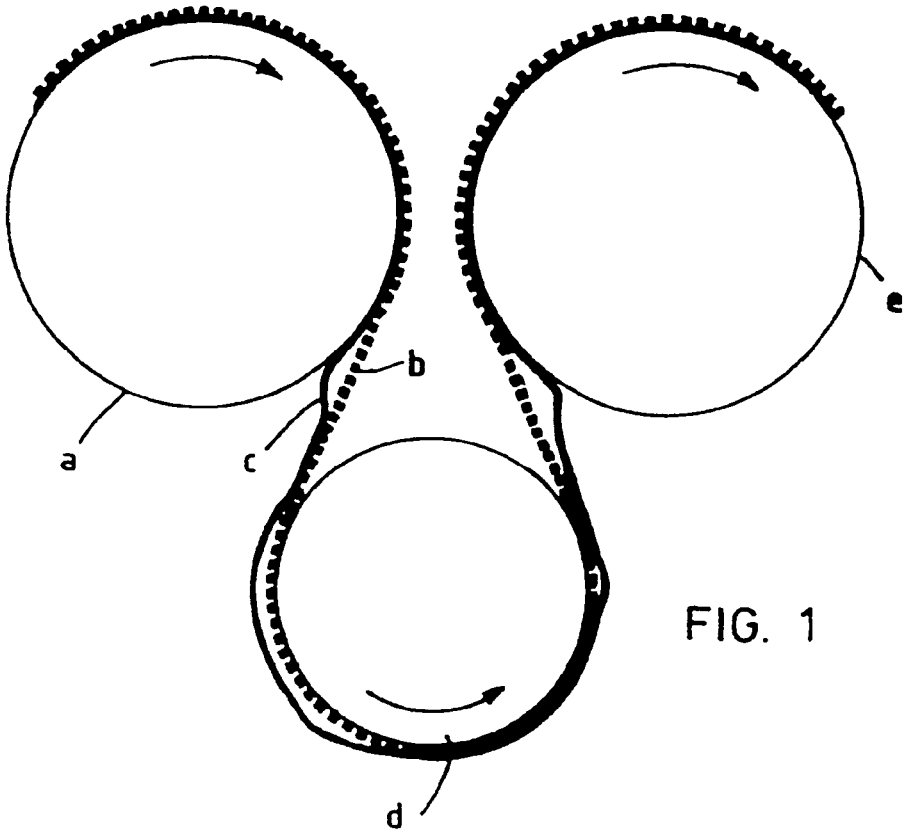

In FIG. 1 of the drawing, one runnability problem arising in paper machines is illustrated exaggerated to some degree for the sake of clarity, which problem concerns stabilizing of the web when no kind of a blow box is used in the pocket space. The reference mark a illustrates a cylinder from which a fabric b and a paper web c move down to a lower cylinder d and further on to a cylinder e. When the fabric b and the web c are detached from the cylinder a, the web c and the fabric b often detach from each other, which usually causes problems. It has also often been noticed that the web c is not in touch with the fabric b at the lower cylinder d as is shown in FIG. 1.

Figure 2:
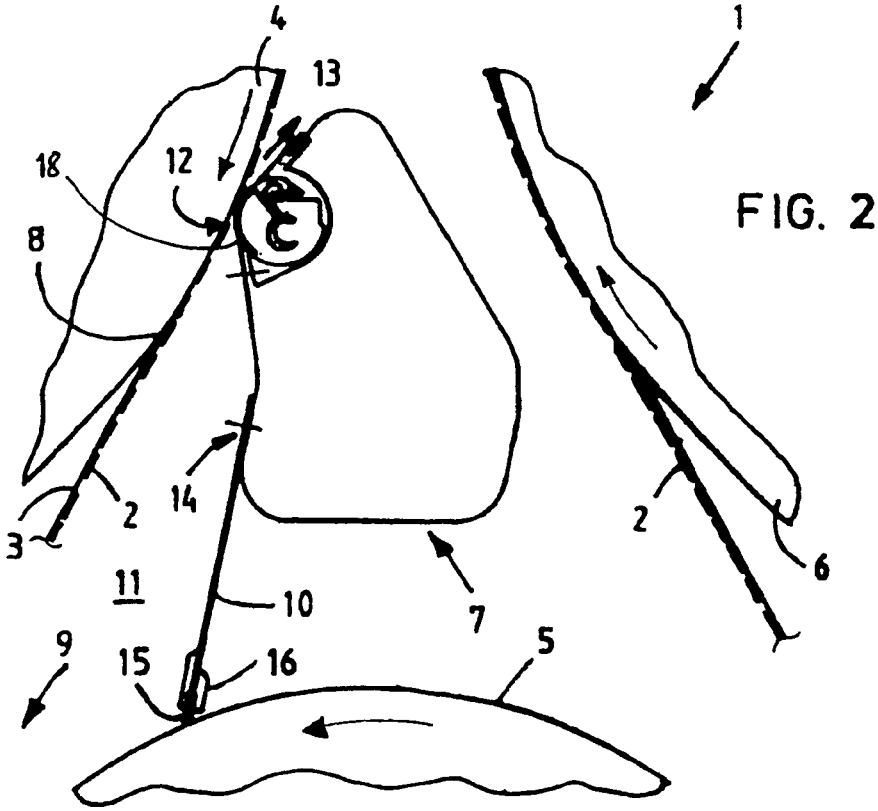
FIG. 2 illustrates one embodiment of an arrangement according to the invention for stabilizing a web in a paper machine and especially supporting of the web towards a fabric in the area between cylinders with the aid of a blow box, FIG. 3 schematically and enlarged illustrates the lower part of the wall and the boundary layer air doctor illustrated in FIG. 2, and FIG. 4 schematically illustrates the blow nozzle illustrated in FIG. 2.

In FIG. 2, the reference number 1 shows an arrangement according to one embodiment of the invention in connection with a fabric 2 for stabilizing a web 3 in a paper machine or the like, in which the web 3 is dried with the aid of cylinders 4, 5 and 6 and possibly also with the aid of air blows, and in which the web 3 is kept supported towards the fabric 2 in the area between the cylinders 4 and 5 with the aid of a blow box 7. The walls of the blow box 7 have most usually been formed of a metal plate by bending and welding and/or by other joining methods. Its width in the cross direction of the web 3 is approximately the width of the web 3 or a little more. An underpressure is arranged into a space 11 formed by an opening nip 8, a closing nip 9 and a wall 10 connected to the blow box 7 by blowing air with the aid of a blow nozzle 12 away from the space 11 i.e. in the direction of an arrow 13. The air to be blown is brought to the blow nozzle 12 along a channel (not shown) arranged in the blow box 7. In the vicinity of the blow nozzle 12 there has also been arranged a flexible nozzle wall 18. The part near the blow nozzle 12 has been arranged to be able to move at least to some extent if, for some reason, impurities, e.g. a so-called paper lump or the like comes down from higher. The blow nozzle 12 is located in the upper part of the blow box 7 some what, e.g. 5-15 cm or even more, above the opening nip 8. The use of this kind of a part that is able to bend elastically and located near the blow nozzle 12 is a technique know per se in this kind of embodiments.

The wall 10 has most suitably been formed of a plate, e.g. an aluminum plate, even though also other materials can be considered for this use. The wall 10 has been attached fairly tightly with screws or the like (not shown) from a point 14 to the front wall of the lower part of the blow box 7, i.e. to the front wall of the blow box 7 in the machine direction. It is recommended to have in elevation direction elongated holes (not shown) in the wall 10, with the aid of which holes an adjustment margin is achieved, which can be e.g. 3 cm. In the lower part of the wall 10 there is a boundary layer air doctor 15, which has been mounted to a support element, i.e. a doctor support 16 in the lower part of the wall 10. The doctor 15 is flexible at least to some extent, and its lower part is quite near the surface of the cylinder 5 or in touch with the surface of the cylinder. The height of the wall 10 is quite high compared to the height of the blow box 7. In one typical embodiment the height of the blow box is about 40 cm and the height of the wall 10 more than 30 cm. The cross section of the blow box 7 can be the same in several different applications, and the underpressure space 11 is formed by choosing a wall 10 of a height suitable for the application. When acting this way, the blow box 7 can be considered as a standard product and the wall 10 is simple to manufacture in pieces of different size according to need, because most usually the wall 10 is a planar piece of plate, which is fairly simple to manufacture.

Figure 3:
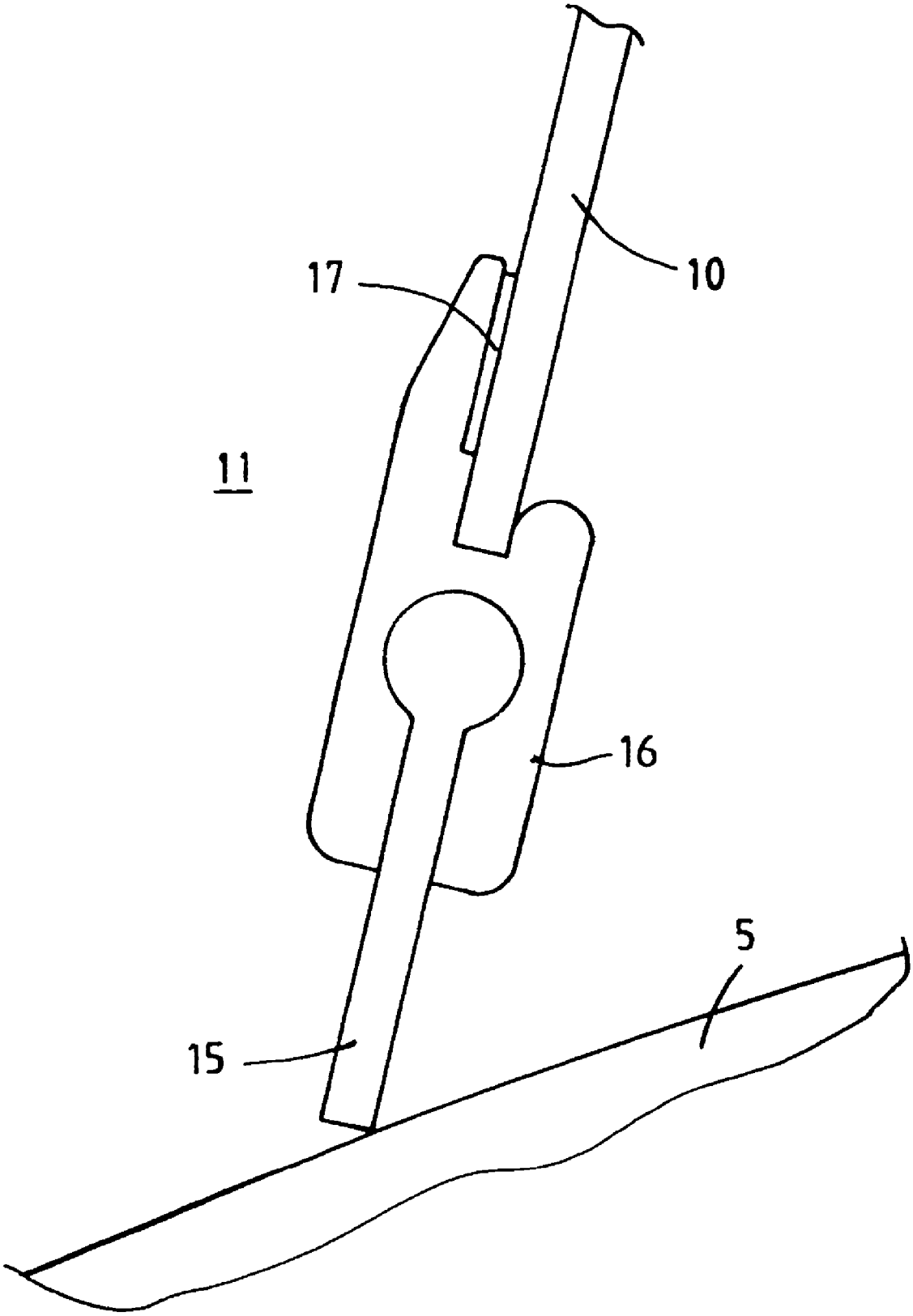

FIG. 3 illustrates more in detail the lower part of the wall 10 according to this embodiment with its doctor 15. In the lower part of the wall 10 there is attached a doctor support 16, which has been attached air tightly to the wall 10 with the aid of a flat seal 17. The doctor 15 it-self is made of a flexible material, e.g. rubber or the like, and the entire lower part of the doctor 15 is fairly thin. In this embodiment the doctor 15 remains in place in the doctor support 16 because the cross section of the upper part of the doctor 15 is circular and the doctor support 16 has a similar structure, even though a suitable spacing is necessary for the sake of the replacement of the doctor. It is to be noted that in the lower part of the doctor support 16 there are fairly long guide surfaces in order to hold the doctor 15 in place. The wall 10 is adjusted with the aid of screws or the like to such a height that the lower part of the doctor 15 slightly touches the surface of the cylinder 5. Thereby leakage passing the doctor 15 is minor and a desired underpressure is easily maintained in the space 11 in order to control the web 3 in the web part after the opening nip 8. The profile of the doctor 15 is such that a worn doctor is easily pulled away and, correspondingly, a new doctor can be set in its place. The structure of the lower part of the wall 10, the doctor support 16 and especially the doctor 15 can be conceived to operate especially as a so-called boundary layer air doctor, as the roll 5 causes, due to its rotary movement, a fairly big air flow near its perimeter surface, and the said doctor eliminates almost entirely the said air flow and especially turbulent flows and their detrimental effects on the web 3 at the space 11. Therefore the doctor 15 is, from its lower part, at least almost in touch with the cylinder 5 in order to attain an efficient boundary layer air doctor effect.

The structures also include end plates (not shown) with the aid of which the space 11 is fairly well closed from both edges of the web 3. Thereby, a required underpressure can be formed into the space 11 so that, via the blow nozzle 12, it is blown air brought at the spot by the ducting of the blow box 7 at least to such an extent that in the central area of the space 11 the air pressure is at least 50 Pa, preferably at least 120 Pa lower that the normal air pressure. This is usually a sufficient underpressure level for controlling the web 3 in the range of influence of the space 11, and especially near and after the opening nip 8.

Figure 4:
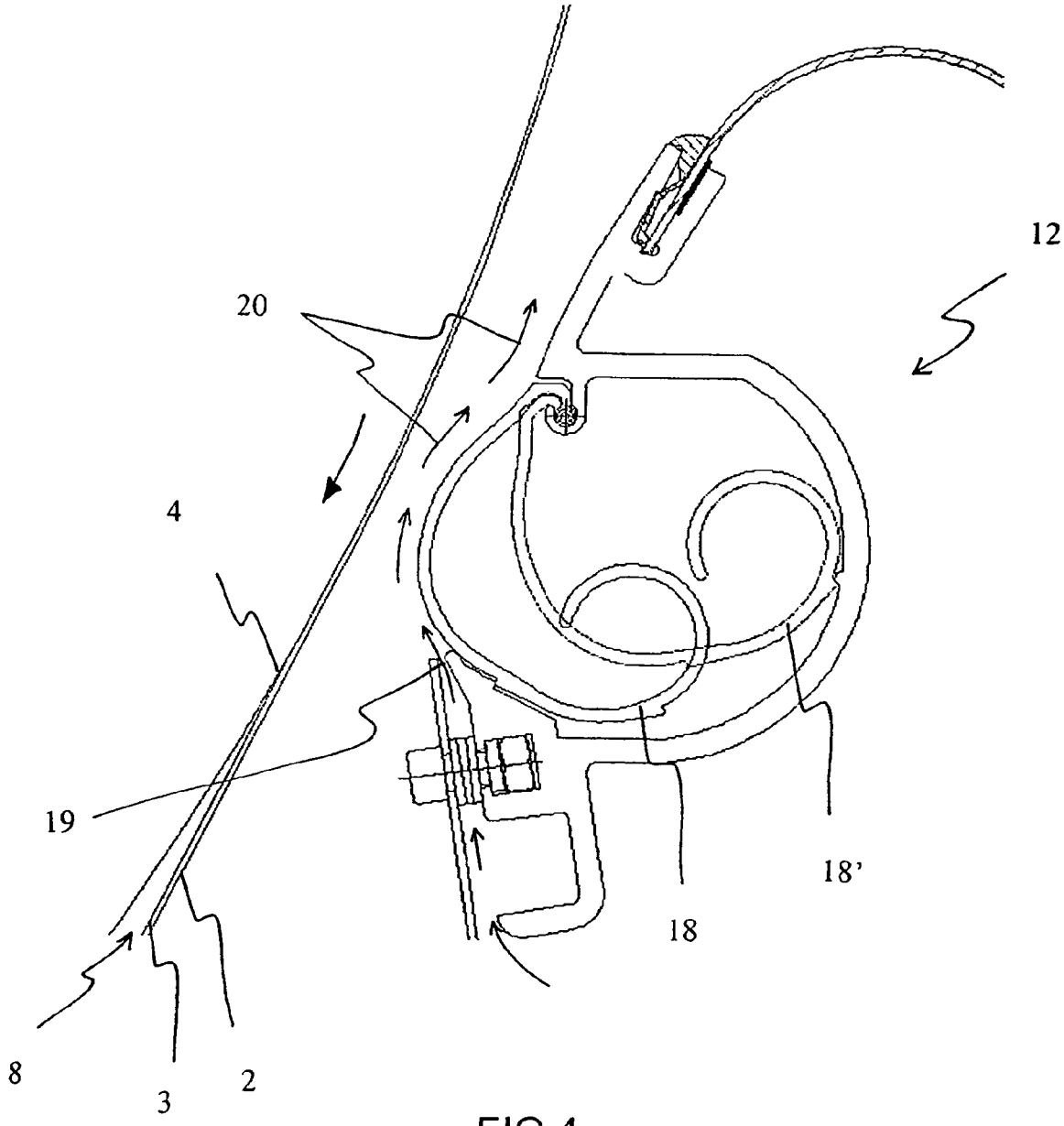

FIG. 4 schematically illustrates the blow nozzle 12 shown in FIG. 2. A nozzle slot 19 and flow of air according to arrows 20 have been illustrated in a blow nozzle according to this embodiment. In the Figure, also the flexible nozzle wall 18 has been illustrated in two different positions, in its position of use (by reference number 18) and in its open position (by reference number 18'), when some foreign matter has come along with the web. Furthermore, cylinder 4, paper web 3 and fabric 2 as well as opening nip 8 have been illustrated in the Figure.

The invention is recommended to be used not only in new machines but also in rebuilds of old machines, both in paper and board machines. The invention is especially suitable for machines having a width of less than 6 m, even though the machine width can of course be even more than this. In the rebuilds of old machines the web speed is usually about 1000 m/min. With the arrangement according to the invention, applications with low energy consumption are attained, and therefore relatively small-sized and economical low-pressure blowers can be used in the production of air.

The invention is not limited to the enclosed embodiment but several modifications of it can be conceived within the scope of the enclosed claims. The reference numbers are not to be considered to limit the invention, either.

What is claimed is:

1. A system for stabilizing a paper web in a paper machine, comprising:

at least three cylinders arranged to define a pocket space between the at least three cylinders;

a blow box disposed in the pocket space, the blow box comprising a blow nozzle, the blow nozzle defining a nozzle slot;

a separate wall extending substantially in the direction of the blow box, the separate wall comprising a first edge and a second edge that are substantially parallel to each other, the separate wall being attached from the first edge to the blow box, and the height of the separate wall in a traveling direction of the paper web is 25-300% of the height of the blow box in the traveling direction of the paper web;

a boundary layer air doctor removably coupled to the second edge of the separate wall and extending substantially unto the surface of one of the cylinders; and a flexible nozzle wall coupled to the blow box;

wherein the first edge of the separate wall is attached to the blow box so that the blow box and the separate wall form a space in the area between an opening nip and a closing nip, and wherein an underpressure is produced in the space between the opening nip and the closing nip to support the paper web towards the fabric in the area between said nips.

2. The system according to claim 1, wherein the height of the wall in the traveling direction of the paper web is 50-150% of the height of the blow box in the traveling direction of the paper web.

3. The system according to claim 2, wherein the height of the wall in the traveling direction of the paper web is 70-100% of the height of the blow box in the traveling direction of the paper web.

4. The system according to claim 1, wherein the boundary layer air doctor is coupled to the second edge of the wall via a support element.

5. The system according to claim 4, wherein the boundary layer air doctor is replaceable without removing the support element or the blow box from the paper machine.

6. The system according to claim 5, wherein the boundary layer air doctor is replaceable by pulling or pushing away the boundary layer air doctor from its location and by pulling or pushing a new boundary layer air doctor to the same location.

7. The system according to claim 4, wherein the support element is coupled to the second edge of the wall via an air-tight flat seal.

8. The system according to claim 1, wherein an underpressure is provided in the space formed by the blow box and the wall that is at least 50 Pa lower than an atmospheric pressure.

9. A paper machine comprising a system for stabilizing a paper web according to claim 1.

10. The system according to claim 1, wherein the flexible nozzle wall flexes via a spring force or a gravitational force.

11. The system according to claim 1, wherein the flexible nozzle wall is stiff and bends about a point of articulation, turning joint, or axis.

* * * * *